United States Patent [19]

Emrich

[11] Patent Number: 4,651,984

[45] Date of Patent: Mar. 24, 1987

[54] METHOD OF AND APPARATUS FOR ACCURATE-REGISTER SHEET TRANSPORT IN A PRINTING MACHINE

[75] Inventor: Helmut Emrich, Offenbach am Main, Fed. Rep. of Germany

[73] Assignee: M.A.N.-Roland Druckmaschinen Aktiengesellschaft, Fed. Rep. of Germany

[21] Appl. No.: 646,130

[22] Filed: Aug. 30, 1984

[30] Foreign Application Priority Data

Sep. 2, 1983 [DE] Fed. Rep. of Germany ..... 3331662

[51] Int. Cl.[4] ..... B65H 9/00

[52] U.S. Cl. ..... 271/237; 198/689.1; 271/94; 271/96; 271/197; 271/243; 271/276

[58] Field of Search ..... 271/243, 237, 276, 197, 271/270, 96, 108, 94; 198/689.1

[56] References Cited

U.S. PATENT DOCUMENTS

| | | | |
|---|---|---|---|
| 3,282,586 | 11/1966 | Schwebel | 271/276 |
| 3,542,360 | 11/1970 | Carey | 271/276 |
| 3,599,967 | 8/1971 | Rapparlie | 271/276 |
| 3,735,976 | 5/1973 | Watson | 271/94 |
| 4,211,399 | 7/1980 | McGowan | 271/276 |
| 4,360,196 | 11/1982 | Weisbach | 271/237 |

FOREIGN PATENT DOCUMENTS

| | | | |
|---|---|---|---|
| 0075685 | 8/1982 | European Pat. Off. | 271/276 |
| 0075121 | 8/1982 | European Pat. Off. | 271/270 |
| 0113622 | 9/1981 | Japan | 198/689.1 |

*Primary Examiner*—Duane A. Reger
*Assistant Examiner*—Matthew C. Graham
*Attorney, Agent, or Firm*—Leydig, Voit & Mayer

[57] ABSTRACT

In a paper transport conveyor from a sheet feeder to a printing machine, the sheets are underlapped for speed reasons and for this purpose, the sheets are held and transported in a defined position using a conveyor table to which a vacuum is applied. In order to optimize the feed register in the printing machine in all states of operation, an additional conveyor device holds the sheets at the front gauges and aligns them. The vacuum at the conveyor table is quantitatively variable and the vacuum is so controlled according to operation as to be applied when sheets are required to be held on the conveyor table but interrupted when its action would obstruct the sheet alignment on the conveyor table.

11 Claims, 6 Drawing Figures

2
22
23
24
8
25
4
5
15
16
7
9
3

2
8
25
24
23
22
4
5
15
16
7
9
3

2
25
8
24
4
5
16
16
7
9
3

2
5
8
25
4
16
16
7
9
3

METHOD OF AND APPARATUS FOR ACCURATE-REGISTER SHEET TRANSPORT IN A PRINTING MACHINE

FIELD OF THE INVENTION

The present invention relates generally to a method and apparatus for the continuous conveyance of underlapped sheets from a feeder to a printing machine or other sheet-fed machine, and more particularly concerns such a conveyor in which the sheets are aligned in accurately registered position on the conveyor device by means of a vacuum.

BACKGROUND OF THE INVENTION

Vacuum-actuated conveyor tables enable sheets to be conveyed in an underlapped arrangement to printing machines and the like. One of the advantages of this arrangement is that the top of the conveyor table is not obstructed by any devices with retaining elements. Consequently, the sheets are readily accessible on the conveyor table in the event of interruptions in the operation. Also, there is no risk of accident and there is no need for any of the elements of the frame to be adjusted.

A method and apparatus of this kind are shown in German Pat. No. 713 529 which describes a sheet conveyor device, and more particularly sheet feeders for letter-press and similar machines. In this specification, endless belts formed with suction ports run over vacuum slots in the conveyor table. Since air is extracted through the slots, sheets of paper are held and conveyed on the perforate belts. A disadvantage of the disclosed arrangement is the low volume of the slots and the provision of a plunger-type vacuum pump. Consequently, the transport with this system is not reliable. Also, relatively high vacuums are required to obtain any substantial transport effect and this results in increased friction of the belts on the conveyor table.

Certain of the disadvantages of the aforementioned apparatus are avoided in a device for automatically loading moistened veneer sheets in a belt or drum dryer and for unloading and stacking the dried veneer sheets, as described in German Offenlegungsschrift No. 2 523 482. In this device, the perforate conveyor belts run on the underside of a large volume vacuum box parallel to its surface, which is formed with apertures therein. On the opposite side the box is provided with a fan as a vacuum source whereby a generally uniformly distributed vacuum is generated over the entire area of the underside of the box and a vacuum storage effect is obtained as a result of the large box volume. A serious disadvantage of this device, however, is that it is impossible to obtain any controlled and accurately adjusted conveyance of imbricated paper sheets per unit of time, particularly since it is designed as a single sheet conveyor. More, particularly, there is no provision for controlling the further conveyance of the individual sheets in the area where they are transferred to the alignment means of a processing machine, which in this case is the sheet dryer. In this regard, the sheet is held fast to the end, without any need for consideration of the position or accurate arrival of the sheet per unit of time.

Other devices have, however, been disclosed to enable the sheet to be aligned. For example, German Pat. No. 836 355 describes a sheet feeder device having additional suction means at the end of the conveyor table operating with conveyor belts. The vacuum means are in the form of vacuum rollers and act from the top on the end of the sheet being conveyed to the front gauges. A disadvantage of this system is that the rollers have to be controlled per unit of time both in respect of their movement and vacuum applied to them. In these conditions it is impossible to ensure that the sheet will not be conveyed too far and bulge at the middle, since it is being held at the front gauges. On other occasions, the next sheet could also be engaged by the vacuum rollers and be conveyed in an uncontrolled manner. Moreover, the complete apparatus has to be accurately adjusted to the sheet end and thus blocks access to the sheet on the feed table.

Another apparatus of this kind is described in German Pat. No. 1 152 707. The sheet deceleration and alignment device described in this patent comprises left and right vacuum chambers in the form of vacuum rollers or vacuum boxes having perforate conveyor belts extending therearound disposed at the conveyor table and adapted to decelerate and align the sheet against the front gauges. The speed of the transport conveyor belts is below the speed of the conveyor table belts and are also disposed adjacent the conveyor table and before the printing machine feed table. They are, therefore, a considerable distance from the front gauges and their action is subject to the risk that the sheet will buckle as it is held against the front gauge due to the conveying effect of the alignment means. While the disadvantage of the previously described device (i.e., alignment means provided above the feed table) is admittedly avoided, the disadvantage in terms of the controls required still exists. Also, the working speed of this feed device is reduced as a result of the reduced transport speed of the additional alignment means.

OBJECTS OF THE INVENTION

It is therefore an object of the present invention to ensure accurate-register feed in a printing machine or the like, with the side gauges being able to draw and align the sheet satisfactorily without the sheet buckling or rebounding from the front gauges. A more particular object is that both the first and last sheet of a print run must be reliably fed in accurate register to the printing machine.

SUMMARY OF THE INVENTION

According to the invention, there is provided a method of continuously conveying a flow of underlapped sheets from a feeder to printing machines or other sheet-fed machines, in which the sheets are held in a defined position on a conveyor device by means of a vacuum characterized in that the vacuum in the conveyor table is adjusted according to the size and weight of the sheets being conveyed; releasing the sheets from the conveyor table when the sheets reach alignment means for the front and side edges thereof; and engaging the sheets by one or more additional conveyor means disposed adjacent the conveyor table near the sheet center to convey the sheets on for alignment against alignment means while the sheets remain movable at their front and side edges for the alignment. Preferably, the vacuum for sheets which are no longer in an underlapping arrangement is discontinued at the conveyor table, according to the volumetric capacity thereof, at a time sufficient for the still underlapped paper sheets to be reliably conveyed over the conveyor table while the non-underlapped sheets are released from the vacuum-actuated conveyor table for alignment movements transversely of the direction of the sheet feed.

In the illustrated embodiment, the additional conveyor means runs at the same speed as or faster than the speed of the sheet transport on the conveyor table and the retaining force at the additional conveyor means is overall less than the traction at the elements provided for the lateral alignment, wherein the additional conveyor means slips beneath the sheets which are held stationary in the direction of sheet movement at the alignment means for the front edge, and, in so doing, applying a propulsive force to the sheet, of a magnitude only such as to prevent the sheet from buckling but holding it at the alignment means.

With the method described and its associated apparatus, it is possible to obtain accurate register characteristics in every situation of the sheet transport between the feeder and the printing machine. The additional drive belt used in front of the front gauges in one specific embodiment prevents the sheet from rebounding from the front gauges and being fed against the latter when the sheet is in an angled position. This is due to the fact that the sheet swings about the drive belt as if about a pivot when held on one side against the front gauges and in this way is completely aligned against the same. Since the drive belt has substantially the same speed as the conveyor table perforate belts and the vacuum at the drive belt operates continuously, a constant propulsive force is applied to the sheet arriving at the front gauges and can align the sheet sufficiently rapidly and bring it to rest there. Moreover, the lateral alignment is not obstructed by the slight retention effect at the drive belt as provided in the preferred embodiment of the invention.

Another feature is that when the last sheet is running over the conveyor table, the vacuum source is switched off. By using the vacuum box volume as a vacuum reservoir for the conveyor table operation it is possible to interrupt the vacuum in sufficient good time for the vacuum to decline only slowly in the vacuum box and be equalized only when the conveyor table no longer carries any sheets. The last sheet can now no longer be held by the conveyor table perforate belts. This is a desirable feature since there is no other sheet available for underlapping to cover the perforate belts. Thus the last sheet of the pile or a print run, or the last sheet before an intentional interruption to printing, can also be cleanly printed without any difficulty occurring on the feed plate. The advantages of the conveyor table conveying sheets by means of a vacuum are sufficiently known, since there is no risk of accident and difficulties in respect of operation such as would be caused by a support frame for rollers and brushes to ensure sheet transport on a conventional feed table having conveyor belts.

The arrangement of the additional drive belt near the front gauges obviates the risk of sheet bulging between the front gauges and the drive belt. Exact front and side alignment of the sheets is also ensured by the small operative area of the drive belt in conjunction with the side gauges, since the rear edge of the sheets is free at the time of the operation, due to underlapping of the next sheet. Preferably, the perforate belts on the conveyor table do not operate if the feeder is stopped but it is immaterial if the additional drive belt continues to run with the front gauges blocked, since the belt then operates in the same way as during normal machine operation. Also, it is much more favorable for the fan to remain in operation for the conveyor table so that the sheets are held fast on the conveyor table in their original underlapped position. The feed unit is, however, freely accessible so that double sheets or sheets having a corrugated or damaged front edge can be removed.

The arrangement according to the invention is very simple because no separate control system is required for the drive belt operation. Both the air extraction and the drive for the drive belt can run completely continuously during machine operation. The small amount of air required eliminates the need for any additional vacuum source. Nor is the control for switching off the conveyor table vacuum subject to any appreciable accuracy requirements, and it can be coupled to the means switching off the pile movement when the pile is exhausted or to the means for switching off the feeder. All that is required is to switch off the fan when the last sheet reaches the table and simultaneously close the throttle valve. The volumetric capacity of the vacuum box is sufficient reliably to hold the last sheets fast on the conveyor table.

BRIEF DESCRIPTION OF THE DRAWINGS

A preferred form of apparatus according to the invention is described hereinafter together with other advantages and features of the invention in conjunction with the drawings in which.

DETAILED DESCRIPTION OF THE INVENTION

Figure 1:
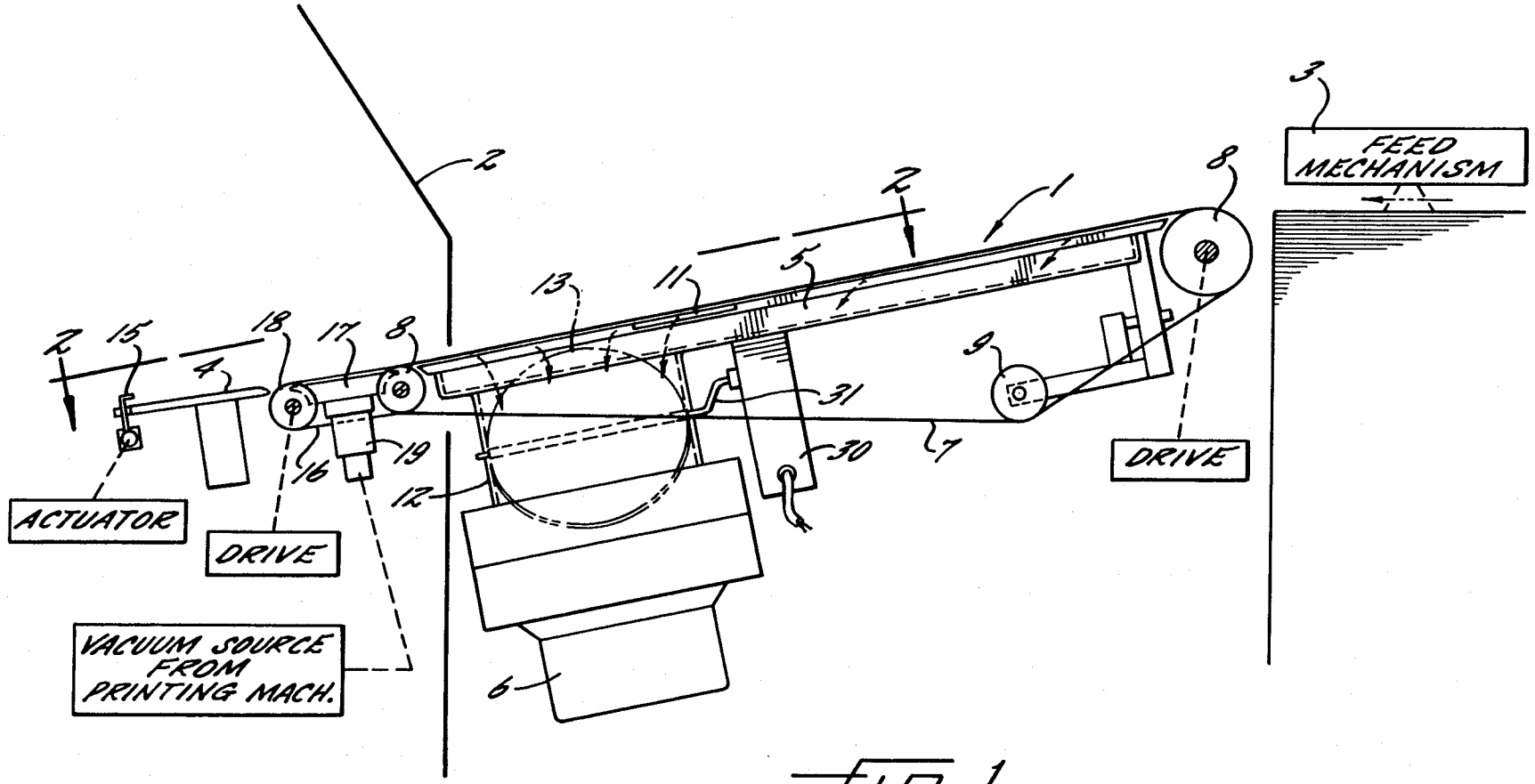
FIG. 1 is a diagrammatic side elevation of the vacuum belt conveyor table and additional conveyor belt adjacent the front alignment gauges of the present invention.

As shown in FIG. 1, a conveyor table 1 for transporting underlapped or imbricated sheets is disposed between a printing machine 2 and feed mechanism 3. In the feeder 3, the sheets are separated from a pile to form an underlapping flow of sheets, and are transferred by the conveyor 1 to the feed section of the printing machine 2 where the sheets individually run over a feed plate 4.

The conveyor table 1 comprises a vacuum box 5 and a suction fan 6. A plurality of endless perforate belts 7 are disposed around the vacuum box 5. The belts 7 are driven by shafts 8 and trained over tensioning rollers 9. Two rows of suction openings 10 are formed in the belts 7 and connect the surface of the conveyor table 1 to the vacuum box 5. Next to the perforate belts 7, the top of the suction box 5 is covered by laterally movable covers 11 consisting of pattern-rolled sheet-metal, so that air can only be drawn in through the openings 10 of the belts 7. The friction of the sheets is very low on the pattern-rolled metal covers 11. A suction tube 12 is connected to the bottom of the vacuum box 5 and contains a rotatable throttle valve 13.

When the fan 6 is in operation, a flow of air passes from the surface of the conveyor table 1 through the suction ports 10 and the vacuum box 5, and on through the suction tube 12, past the throttle valve 13, to the fan 6. The air flow through the vacuum box 5 is controllable by the laterally movable cover plates 11 with respect to the sheet format required, the cover plates 11 being adapted to be pushed beneath the outer rows of suction ports 10 in the perforate belts 7, and the volume of air can be adjusted by changing the outlet aperture at the fan 6.

Figure 2:
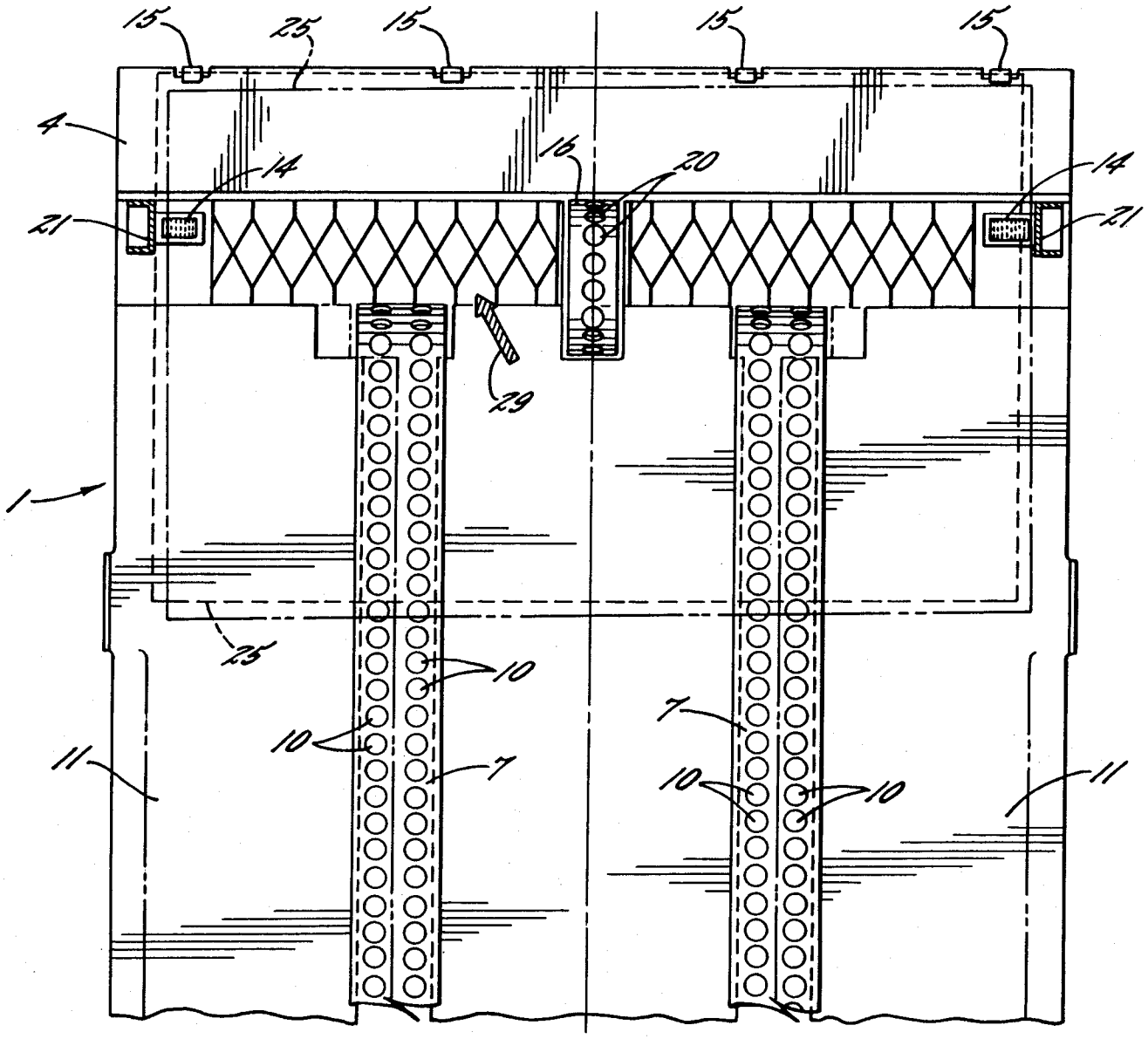
FIG. 2 is a fragmentary plan view of the sheet feed zone portion of the apparatus shown in FIG,. 1; and, FIGS. 3*a–d* are schematic diagrams of the sheet transport over the conveyor table to the front alignment gauges.

It will be seen from FIG. 2 that an additional conveyor device is disposed midway between the perforate belts in the region of the feed plate 4 at the level of a pair of lateral side gauges 14 and near a plurality of front gauges 15, both of which are of known construction. It consists of a drive belt 16 formed with suction ports 20 and extending endlessly around a vacuum element 17. The belt 16 is driven constantly and tensioned by way of shafts 18. A vacuum connection 19 is provided at the vacuum element 17, and air is drawn from connection 19 through the ports 20 in the belt 16. Preferably the belt 16 runs at a speed equal at least to the speed of the perforate belts 7 and the vacuum for the element 17 is not controlled as to time but is applied continuously. Consequently, the retaining forces at the suction ports 20 in the belt 16 are always identical. These retaining forces should be so adjusted that the sheet is not held fast, but is simply propelled forward slightly. In this way the belt 16 will always slip under the sheet bearing against the front gauges 15.

Due to the proximity to the front gauges 15, the sheet cannot buckle, which would cause feed difficulties. This also ensures that the sheet can be drawn by the lateral side gauges 14 against the side abutments 21 without any difficulties for the purpose of lateral alignment.

Pursuant to the invention, the additional conveyor device requires no adjustment during operation, but has a constant setting both in respect of its operation and in respect of its position during a print run. The suction effect at the vacuum element 17, however, should be adjustable in dependence on the paper weight, and the vacuum must be greater than at the vacuum box 5, since a larger operative area is available there. To this end, the vacuum air connection at the element 17 is simply connected to the vacuum source of the printing machine 2, and it will be seen hereinafter that this is also advantageous and imposes only a very small load on the vacuum source due to the very low air consumption.

Referring to FIGS. 3*a* to 3*d*, the apparatus described operates as follows by the method according to the invention. Sheets 22–25 are conveyed in underlapped fashion from the feeder 3 over the conveyor table 1 to the front gauges 15 and into the printing machine 2.

Figure 3A:
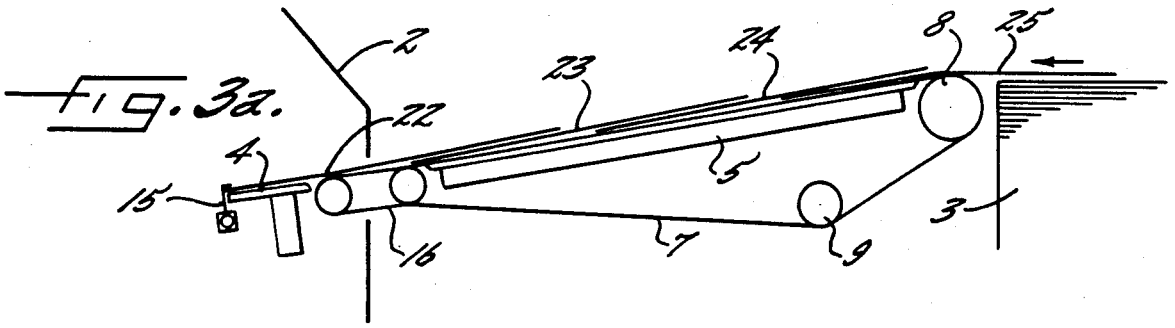

In FIG. 3*a* the sheet 22 is situated just at the front gauges 15, where it is momentarily held by the slipping action of the drive belt 16. At this time, the sheets 23 and 24 are situated in an underlapping arrangement behind the sheet 22 on the conveyor table and the sheet 25 is pushed beneath the sheet 24 from the feeder 3.

Figure 3B:
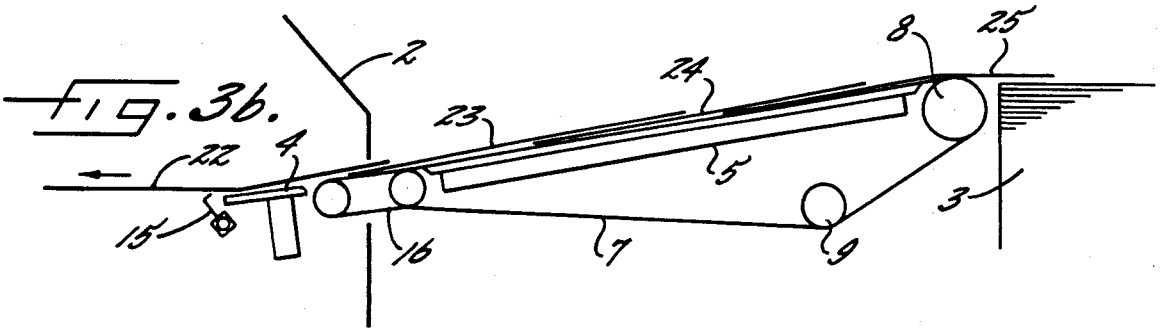

FIG. 3*b* shows the first sheet 22 having just been drawn into the printing machine 2, the sheet 23 runs from the conveyor table 1 onto the feed plate 4, while the sheets 24 and 25 are being further conveyed on the conveyor table 1. During transport, the sheets 23, 24 25 are each held by the vacuum effect of the conveyor table 1 only at their front non-underlapped portions.

Figure 3C:
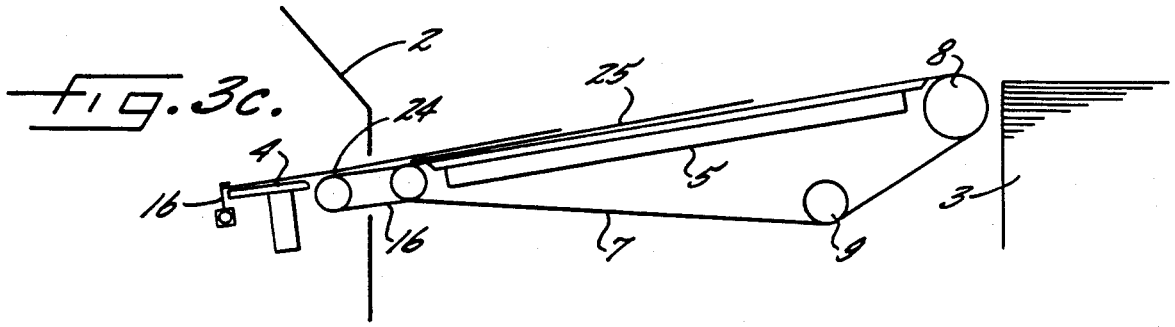

In FIG. 3*c* the penultimate sheet 24 has just moved up to the front gauges 15 where it is held by the drive belt 16 by means of the suction effect of the vacuum element 17. In these conditions belt 16 continuously slips beneath the sheet 24 and by friction transmits to the sheet 24 a force directed against the front gauges 15. At the same time, the sheet 25 has been conveyed on as far as the end of the conveyor table 1. The underlap provided by the sheet 25 beneath the sheet 24 has the effect that the conveyor table 1 can no longer exert any suction on the sheet 24, which is thus released for lateral adjustment.

Figure 3D:
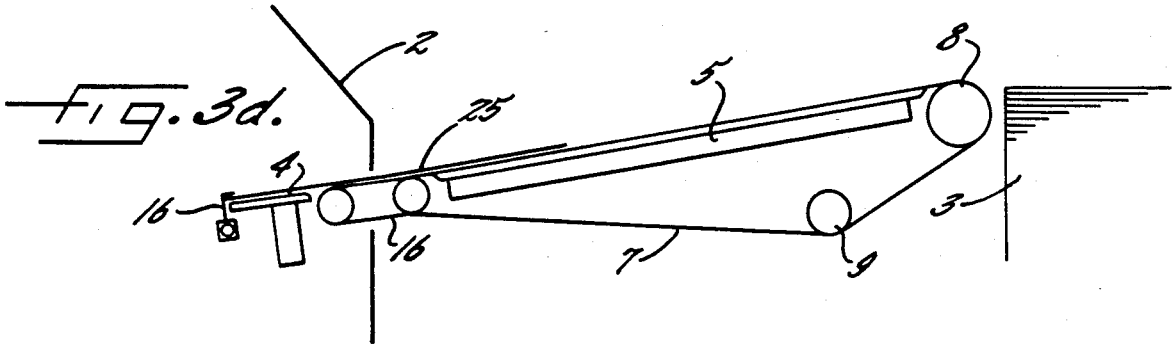

FIG. 3*d* shows the conditions in respect of the last incoming sheet. Sheet 25 may, for example, be the last sheet of a print run or the last sheet of a pile from the feeder 3. If sheet 25 were allowed to enter the feed unit without any precautions, it would still be held fast by the conveyor table 1 since its trailing edge would not be underlapped by an oncoming sheet and since vacuum is still being applied at this time to the vacuum box 5. In such cases it would no longer be possible to ensure that the side gauges 14 would pull the sheet 25 satisfactorily into alignment.

According to the invention, provision is made to interrupt the vacuum, when the last sheet 25 for printing arrives on the conveyor table 1. Throttle valve 13 is therefore closed when sheet 25 has arrived on the conveyor table 1, as shown in FIG. 3*b*. This is effected by rotating the cranked spindle 31 by means of the electromagnet 30 to turn the throttle valve into the horizontal position shown in FIG. 1. It will be understood, of course, that the vertical position of throttle valve 13 is the open position. The volumetric capacity of the vacuum box 5 is such that the vacuum therein reduces only slowly. In normal operation, sufficient reduction of the vacuum is not obtained until the sheets 23 and 24 are clear of the conveyor table 1, i.e., when the last sheet 25 arrives at the front gauges 15, where it is held by the drive belt 16. The vacuum in the vacuum box 5 is then so low that the slight retaining forces acting on the underside of the sheet 25 still resting on the conveyor table 1 can no longer obstruct lateral adjustment by the side gauges 14. In this way the last sheet 25 can also be properly aligned and printed satisfactorily without any register problems.

The advantages of the arrangement of the additional conveyor device for feed register in the printing machine 2 will be more readily apparent upon reference again to FIG. 2 which shows sheet 25 entering at an angle against the front gauges 15. Due to its angled position, sheet 25 first encounters the upper or right hand front gauge 15. The driving force of the perforate belts 7 is interrupted by the next sheet (not shown here) and the drive belt 16 is then responsible for further transport of the sheet 25 by means of the vacuum element 17.

Since belt 16 is disposed in the middle of the feed plate 4, the sheet 25 can swing around on the drive belt 16 (or around the operative surface of the suction ports 20 in the drive belt 16), since the sheet is held against the upper front gauge 15, and the sheet can be conveyed on until it contacts the lower front gauge 15. One of the main reasons why this is possible is that there is an intentional slip provided between the sheet 25 and the drive belt 16, i.e., the belt 16 slips beneath the sheet 25 or the sheet can move with respect to the belt 16.

Exact lateral alignment is not obtained until the sheet 25 also bears against the lower front gauge 15. Since drive belt 16 acts continuously on sheet 25, this alignment toward the lower front gauge 15 will occur even during the lateral adjustment process. Because of the high machine speeds, however, the drive belt 16 must move at least at the sheet transport speed of the conveyor table 1 in order to carry out the alignment process sufficiently quickly. Thus the sheet 25 is moved diagonally, as shown in exaggerated form by arrow 26, in the feed direction against the side abutment 21 and the front gauges 15 by the action of the side gauges 14 and drive belt 16. This is the position shown in broken lines in FIG. 2 and ensures that the sheet 25 is aligned satisfactorily for printing in the machine 2.

Other features provided in the apparatus for the purposes of accommodating different types of paper, are provided by adjustment of the outlet aperture of the fan 6 and moving the cover plates 11 transversely of the direction of sheet movement beneath the perforate belts 7. Thus for lighter-weight papers it is possible to reduce the vacuum or, in the case of smaller formats, operate just half the suction ports 10 in the perforate belts 7. This is also important when heavier-weight papers are printed. Such cases also require adjustment of the suction effect at the additional conveyor device. Overall, however, only a very few adjustment operations are required and are needed only in the case of extreme paper differences. The apparatus is very flexible and the method ensures that operation of the entire sheet feeder is very simple and can be carried out in a minimum amount of time.

Other advantages of the apparatus are the provision of the fan 6 in the conveyor table 1 and the interrupted action of the drive belt 16 and of the vacuum element 17. In the event of any interruption to printing resulting in the feed being blocked due to blocking of the front gauges 15, due to printing malfunction or because two sheets have entered the feeder at once, the feeder 3 can be disconnected from the printing machine 2. Preferably, the vacuum in the vacuum box 5 of the conveyor table 1 remains in operation, however, and holds the sheets fast on the conveyor table 1 in their original position. If the cause for the interruption is to be found in the printing machine 2, printing can be continued immediately after the fault has been cleared since the sheet at the front gauges 15 also retains its position without any special steps being necessary.

When the last sheet runs over the conveyor table 1 and the vacuum is interrupted by the throttle valve 13, it is important that there should still be vacuum at the vacuum element 17 to enable the drive belt 16 to function. This is possible by connecting the suction element 17 to the air supply of the printing machine 2, which in that case is not interrupted. On the other hand, the vacuum at the vacuum element 17 is also shut down when the printing machine 2 is switched off, since the air supply is also disconnected in such cases. In this way it is possible to adjust the front gauges 15 and side gauges 14 with a loosely inserted sheet.

I claim as my invention:

1. A method for continuously conveying a flow of underlapped sheets from a feeder to a printing machine or the like having a sheet feed plate and front alignment means, in which the sheets are held in a defined position on a conveyor table by means of a vacuum in a box with endless perforated belts rotating around and travelling over apertures at the top of the box and plates fitted loosely on the conveyor table adjacent the perforated belts, characterized in that the vacuum in the conveyor table is adjusted according to the size and weight of the sheets being conveyed by reducing the cross-section of the air inlet at the conveyor table by sliding the plates beneath the perforated belts to cover the apertures at the top of the vacuum box, releasing the sheets from the vacuum actuated conveyor table when the sheets reach the front alignment menas, and engaging the sheets by one or more additional conveyor means disposed adjacent the exit of the conveyor table and near the sheet center to convey the sheets on for alignment against the alignment means wihle the sheets remain movable at their front and side edges for the alignment.

2. A method according to claim 1, characterized in that the vacuum for sheets which are no longer in an underlapping arrangement is discontinued at the conveyor table according to the volumetric capacity thereof, at a time sufficient for the still underlapped paper sheets to be reliably conveyed over the conveyor table while the non-underlapped sheets are released from the vacuum-actuated conveyor table for alignment movements transversely of the direction of the sheet feed.

3. A method according to claim 1, characterized in that the additional conveyor means run at the same speed as or faster than the speed of the sheet transport on the conveyor table and the retaining force at the additional conveyor means is overall less than the traction at the elements provided for the lateral alignment.

4. A method according to claim 1, characterized in that the additional conveyor means are operated at constant speed and constant retention, said means slipping beneath the sheets which are held stationary in the direction of sheet movement at the alignment means for the front edge, and, in so doing, applying a propulsive force to the sheet, of a magnitude only such as to prevent the sheet from buckling but holding it at the alignment means.

5. Apparatus for continuously conveying a flow of underlapped sheets from a feeder to a printing machine or the like having a sheet feed plate and front alignment means, comprising, in combination, a conveyor table having a vacuum box, endless perforated belts rotating around and travelling over apertures at the top of the box, and additional conveyor means disposed in the region of the feed plate adjacent the front alignment means, said additional conveyor means including a continuously rotating endless drive belt formed with suction ports which travels around a continuously operable vacuum element and is driven by shafts, a vacuum connection on the vacuum element for air to be extracted through the suction ports of that part of the drive belt which is moving in the plane of the feed plate, said vaccuum being applied such that the endless drive belt slips under the center of the sheets which are held by the front alignment means and means on the vacuum box for reducing the cross-section of the air inlet at the conveyor table including movable cover plates fitted loosely on the conveyor table adjacent the perforated belts on the vacuum box, said plates being selectively movable beneath said belts without said box being opened simultaneously elsewhere.

6. Apparatus according to claim 5, characterized in that additional conveyor means is disposed adjacent the exit end of the conveyor table so as to engage the forward portion of a sheet while the rear ward portion of the sheet is blocked from the suction of the vacuum box by the forward portion of the next underlapped sheet.

7. Apparatus according to claim 5 including a fan which closes the bottom of the vacuum box and means for reducing the cross section of the air outlet from the conveyor table at the fan.

8. Apparatus according to claim 7, characterized in that the means for reducing the cross section of the air outlet is in the form of an electromatically controlled throttle valve disposed in the suction tube betwen the vacuum box and the fan, said valve being pivoted about a spindle by an electromagnet.

9. Apparatus according to claim 8 characterized in that the electromagnet for controlling the throttle valve and the drive for the fan are so connected to the drive for the feeder in respect of control that in normal feeder operation the fan operates with the throttle valve open, and during machine-conditional interruptions to printing the fan also operates, but the throttle valve is closed and the fan switched off when the feeder is stopped in the event of exhaustion of the paper pile, on conclusion of a print run, or other non-machine-conditional interruptions to printing.

10. Apparatus according to claim 5, characterized in that means are provided remote from the conveyor table and in communication with the feeder for disconnecting the vacuum to the box when the feeder is stopped but the printing machine continues the run.

11. Apparatus according to claim 10, further characterized in that the means for disconnecting the vacuum is activated in sufficient time for the vacuum level to decline slowly in the vacuum box and be substantially equalized when the conveyor table no longer carries any sheets.

* * * * *